US005894835A

United States Patent [19]

Simonds

[11] Patent Number: 5,894,835

[45] Date of Patent: Apr. 20, 1999

[54] METHOD FOR MANUFACTURING CONTINUOUS COMPRESSION MOLDED ARCHERY BOW LIMB PORTIONS AND THE ARCHERY BOW LIMB PORTIONS PRODUCED THEREBY

[75] Inventor: Gary L. Simonds, Gainesville, Fla.

[73] Assignee: Bear Archery, Inc., Gainesville, Fla.

[21] Appl. No.: 08/720,041

[22] Filed: Sep. 27, 1996

[51] Int. Cl.[6] ..... F41B 5/00

[52] U.S. Cl. ..... 124/23.1; 264/157; 264/325

[58] Field of Search ..... 124/23.1, 86, 88; 156/169, 173, 175; 264/157, 297.5, 324, 325

[56] References Cited

U.S. PATENT DOCUMENTS

| | | | |
|---|---|---|---|
| 4,350,138 | 9/1982 | Caldwell | 124/25.6 |
| 4,414,049 | 11/1983 | Jones | 156/169 X |
| 4,649,889 | 3/1987 | Johnston | 124/23.1 |
| 4,659,071 | 4/1987 | Woltron | 156/169 X |
| 4,735,667 | 4/1988 | Johnston | 156/175 |
| 5,141,689 | 8/1992 | Simonds | 124/23.1 X |

OTHER PUBLICATIONS

Hoyt USA 1996 Catalog, p. 3.

"Bow Report—High Country Split Force", *Bowhunting world*, Oct. 1996.

*Primary Examiner*—John A. Ricci

*Attorney, Agent, or Firm*—Malina & Wolson

[57] ABSTRACT

The method of the present invention comprises inserting a moldable slug having a plurality of longitudinally oriented resin impregnated predominantly glass fiber filaments into a bow limb profiling mold. The mold consists of two halves, the first half containing two female cavities and a second half having two matching fitted male sections. Each cavity receives a predetermined volume and weight of continuous longitudinal fibrous reinforcement material and plastic resin matrix material. Heat and pressure are applied during initial curing and the uncured end is removed. The slug is then finally cured.

15 Claims, 4 Drawing Sheets

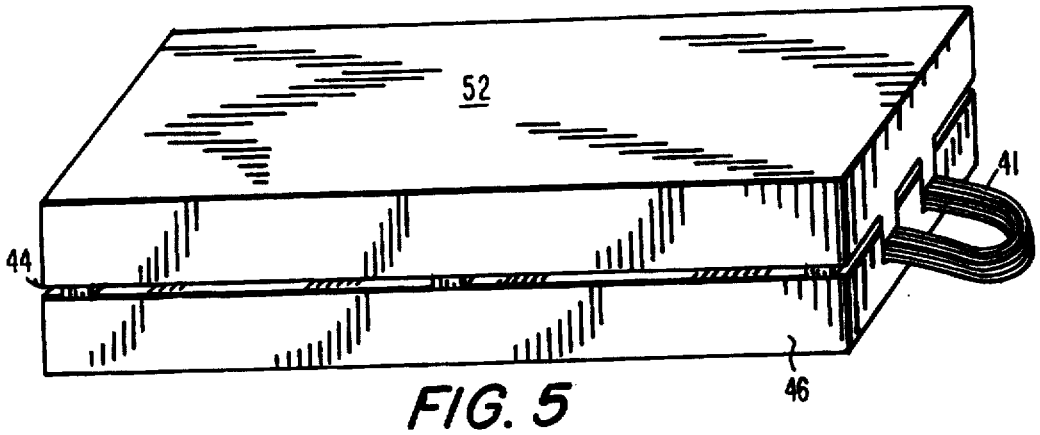
FIG. 5
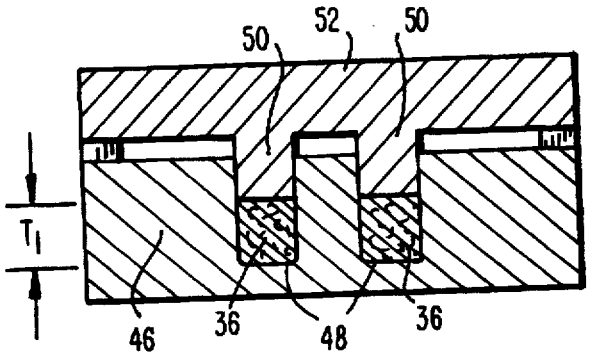
FIG. 6
FIG. 7
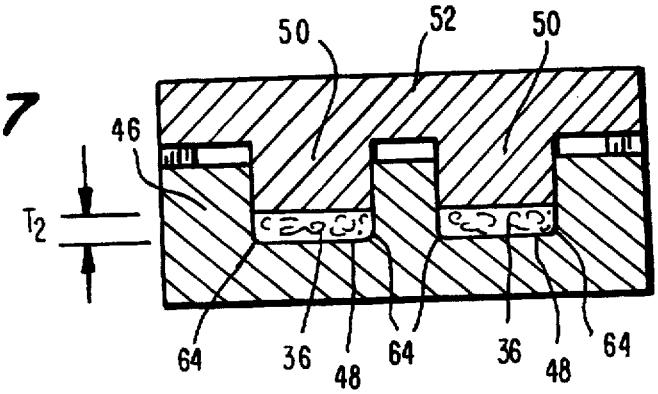

METHOD FOR MANUFACTURING CONTINUOUS COMPRESSION MOLDED ARCHERY BOW LIMB PORTIONS AND THE ARCHERY BOW LIMB PORTIONS PRODUCED THEREBY

BACKGROUND OF THE INVENTION

1. Field of the Invention

The present invention relates generally to archery bows and more particularly pertains to an improved compression molded archery bow limb for use in a compound bow and method for manufacturing the same.

2. Description of the Prior Art

Archery bow limbs perform the important function of storing energy when the archer draws the bowstring. When the bowstring is drawn, the pre-stressed bow limbs, which are typically made of resilient material, are further flexed to store additional energy. When the bowstring is released, the stored energy propels the arrow.

In conventional compound bows, the limb is typically formed of a single element of rectangular cross section, wherein one end is attached to the bow handle and the other end has a limb tip slot formed therein, in which an eccentric wheel is mounted.

Reinforced glass fiber materials have been utilized in archery bow limbs for a number of years. In some instances, the limb profile is machined from extruded solid glass fiber billets, and in other instances the limb profile is machined from pre-formed compression molded billets, which in some cases may be pre-formed to such near net shape that only secondary machining operations are required to remove excess material from the limb tip area and from the butt slot area, where the limb is joined to the handle. In all such cases, the secondary machining operations are costly and time consuming. Further, the machining operations result in the severing of load bearing fibers which reduces the maximum limb operating stress level and the fatigue life of the limbs.

To lessen the problems associated with machining the reinforced glass fiber material, several processes have been developed, such as those disclosed in U.S. Pat. Nos. 4,649,889; 4,660,537; and 4,735,667. More recently, there is disclosed in U.S. Pat. No. 5,141,689, issued to G. Simonds, a method of forming a partial limb tip slot in a molded limb profile, and then severing the remaining glass fibers in the limb tip slot area to form the limb tip. This method reduces the number of glass fibers that are severed so that the fatigue life of the resultant limb tip is substantially improved, and the necessity of providing reinforcement washers to the limb tip slot is avoided. It is not believed, however, that a glass fiber limb for a compound bow has been produced which completely avoided having to sever glass fiber filaments when the limb tip slot was formed.

Further, it was popularly believed (see, for example, U.S. Pat. No. 4,735,667, issued to R. Johnson) that glass fiber limbs should be of a substantially constant cross sectional area in order to maintain a constant glass fiber to resin ratio in the limb.

Thus far the discussion has been concerned with conventional compound bows formed with single element glass fiber limbs of rectangular cross section. A different approach is disclosed in U.S. Pat. No. 4,350,138, issued to J. Caldwell. The limb portions disclosed therein are formed of left and right limb portions. Significantly, the limb portions disclosed therein are not compression molded, and it is not believed that any such split limb portions have been formed by compression molding despite the fact that the compression molding of limbs has been widely known for many years. More contemporaneous versions of such split limbs are, for example, being sold by Hoyt U.S.A. under the Alpha Tec mark and by High Country under the Split Force mark.

SUMMARY OF THE INVENTION

The present invention is concerned with a method for manufacturing continuous compression molded archery bow limb portions and the archery bow limbs produced thereby.

The limb portions comprise compression molded upper left and right limb portions and compression molded lower left and right limb portions. In this manner, the respective left and right limb portions form the limb tip slots and the costly and time-consuming limb tip slot machining process is avoided, together with the attendant disadvantages associated with such machining, namely, the reduction in the maximum limb operating stress level and the reduction in the limb fatigue life. Further, and contrary to the teaching of the prior art, the upper and lower left and right limb portions may be provided with a varying cross sectional lengthwise profile so that the glass fiber to resin ratio may be made higher in the limb portion area which experiences high stress and lower in the limb portion area in which perhaps more stiffness is desired. Still further, it is desirable that the complementary left and right limb portions have identical glass fiber to resin ratios throughout the length of the limbs and identical physical mirror image configurations and that is achieved through the present invention.

The method of the present invention comprises inserting a moldable slug having a plurality of longitudinally oriented resin impregnated predominantly glass fiber filaments into a limb portion profiling mold. The limb portions comprise a right limb portion and a left limb portion. The mold consists of two halves, the first half containing two female cavities and a second half having two mating male sections. The first cavity is profiled to provide the configuration of the right limb portion and the second cavity is profiled to provide the configuration of the left limb portion. The cavities are in parallel relationship with each other and are connected. Each cavity receives a pre-determined volume and weight of continuous longitudinal fibrous reinforcement material and plastic resin matrix material. Heat and pressure are applied during initial curing and the uncured end is removed. The slug is then finally cured, either in its entire length or after being severed into a left limb portion and a right limb portion.

Accordingly, it is an object of this invention to provide a method of manufacturing compression molded continuous left and right archery bow limb portions, and the archery bow having limb portions produced thereby.

It is a further object of this invention to provide a method of manufacturing compression molded archery bow limb portions having varying cross sectional lengthwise profiles, and the archery bow having limb portions produced thereby.

It is a still further object of this invention to provide a method for producing compression molded complementary compound left and right archery bow limb portions having identical glass fiber to resin ratios throughout the length of the limb portions and identical mirror image physical configurations.

Other objects and attendant advantages of this invention will be readily appreciated as the same become more clearly understood by references to the following detailed description when considered in connection with the accompanying drawings in which like reference numerals designate like parts throughout the figures thereof.

BRIEF DESCRIPTION OF THE DRAWINGS

Further objects and advantages of the present invention will become apparent as the following description of an illustrative embodiment takes place, taken in conjunction with the accompanying drawing, in which:

FIG. 5 is a perspective side elevation view of the mold assembly during curing with the filament tail extending from the mold assembly.

FIG. 6 is a sectional elevation view taken approximately along line 6—6 of FIG. 4 viewed in the direction of the arrows.

FIG. 7 is a sectional elevation view taken approximately along line 7—7 of FIG. 4 viewed in the direction of the arrows.

DETAILED DESCRIPTION OF THE PREFERRED EMBODIMENT

Figure 1:
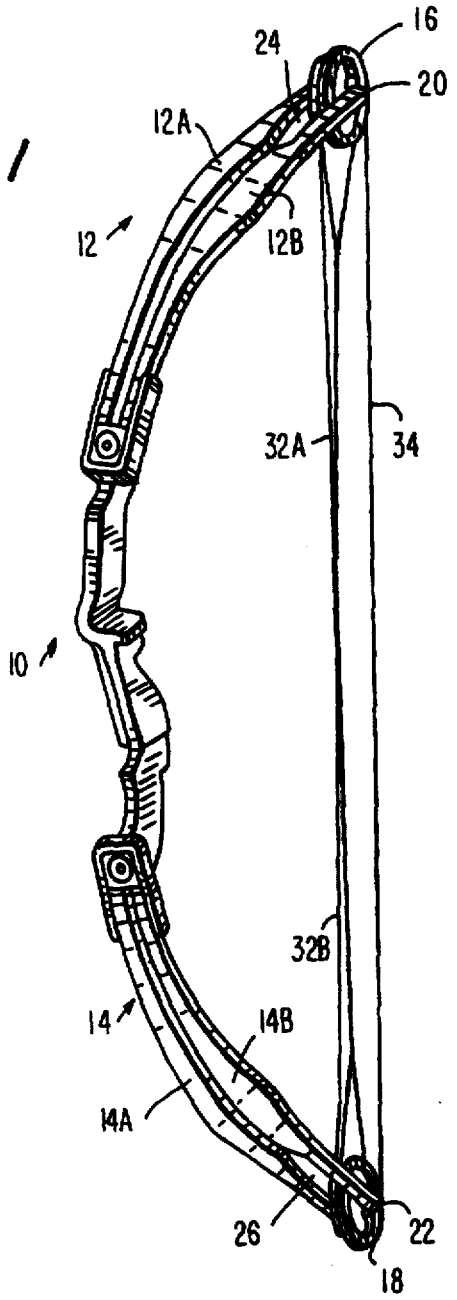
FIG. 1 is a perspective view of a compound archery bow illustrating the various components thereof and including the bow limb portions of the present invention.

In the illustrated embodiment of FIG. 1, a compound archery bow generally designated as 10 includes, when viewed from the perspective of an archer holding the bow 10, an upper right limb portion 12A, an upper left limb portion 12B, a lower right limb portion 14A and a lower left limb portion 14B. Centrally disposed variable leverage units such as eccentric pulleys 16 and 18 are supported for rotary movement about axles 20 and 22. The axle 20 is carried in the outer limb tip portions between upper right limb portion 12A and upper left limb portion 12B, which form limb slot 24. The axle 22 is carried in the outer limb tip portions between lower right limb portion 14A and lower left limb portion 14B, which form limb slot 26.

One end of bowstring 34 extends to the upper end of the bow where it wraps around at least a portion of the eccentric pulley 16 and is connected thereto, and the other end of bowstring 34 extends to the lower end of the bow where it is trained around a portion of eccentric pulley 18 and is connected thereto. Anchor cable 32A extends from eccentric pulley 16 to the extremities of axle 22. The other anchor cable 32B extends from eccentric pulley 18 to upper axle 20. The opposed pairs of upper bow limb portions 12A and 12B and lower bow limb portions 14A and 14B are relatively short and will characteristically have high spring rates.

When the bowstring 34 is drawn, it causes eccentric pulleys 16 and 18 at each end of the bow to rotate, which shortens the length of the anchor cables 32A and 32B to bend the limb portions 12A, 12B, 14A and 14B causing additional energy to be stored therein. When the bowstring 34 is released with an arrow attached to the bowstring, the limb portions 12A, 12B, 14A and 14B return to their rest position, causing the eccentric pulleys 16 and 18 to rotate in the opposite direction to take up the bowstring 34 and launch the arrow with an amount of energy proportional to the energy initially stored in the bow limbs.

Figure 2:
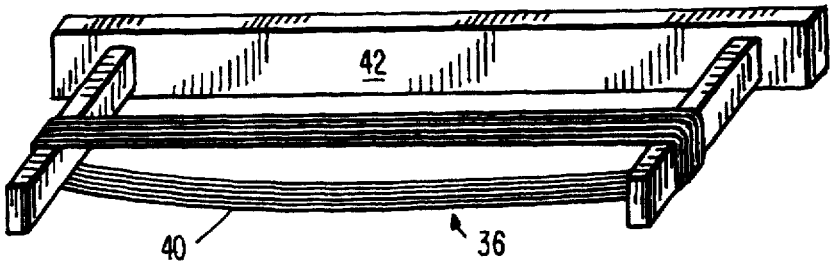
FIG. 2 is a perspective side elevation view of a slug frame with impregnated filaments wrapped thereon.

Referring to FIG. 2, there is illustrated the glass fiber slug 36 from which the bow limb portions 12A, 12B, 14A and 14B of the instant invention are fabricated. Glass fiber filaments 40, which form the glass fiber slug 36, are initially drawn through a wet out tank containing a suitable resin. After absorbing the desirable amount of resin, the glass fiber filaments 40 are wrapped around frame 42. Each wrap consists of one complete turn or loop around a frame 42. A plurality of wraps are necessary to form each limb set and therefore each slug 36 consists of a number of individual wraps.

Both the glass fiber and the resins used in this process are well known in the art. Suitable materials include glass fiber filaments packaged in spools and sold by Pittsburgh Plate Glass Corp. under the designation No. 712-218 to be employed with Shell 826 epoxy resin and a suitable heat activated catalyst such as Lindride 6K manufactured by Lindow Chemical Company. It has been found that the range of suitable glass fiber to resin ratios by weight is from 60% to 75% which is the equivalent of a glass fiber to resin ratio by volume in the range of 42% to 59%.

Figure 3:
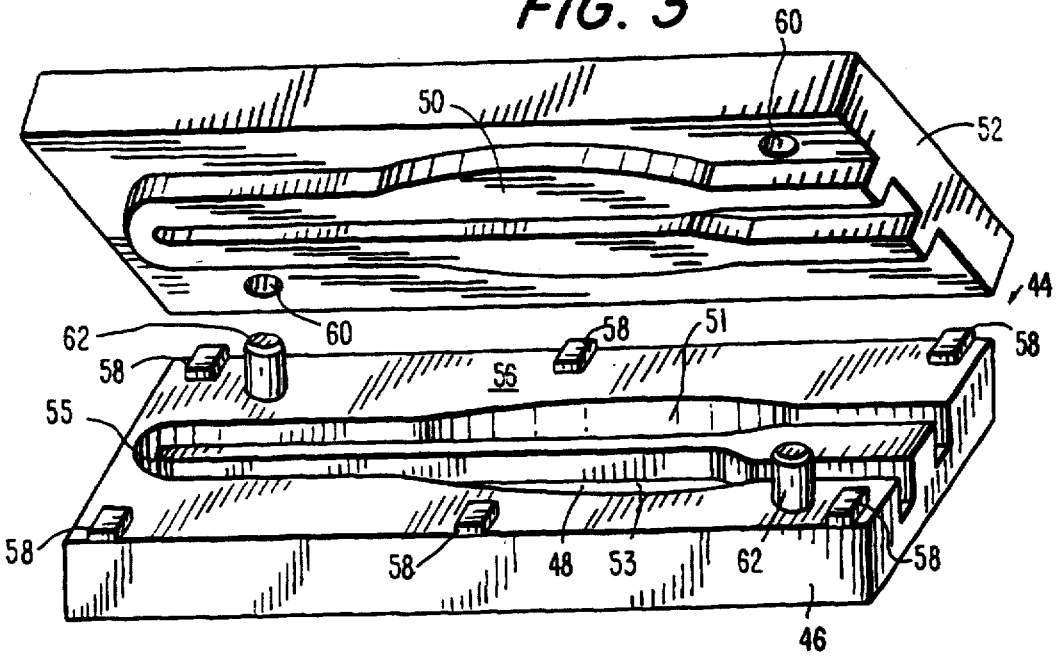
FIG. 3 is a perspective side elevation view of the mold assembly used in producing the bow limb portions of the present invention.
Figure 4:
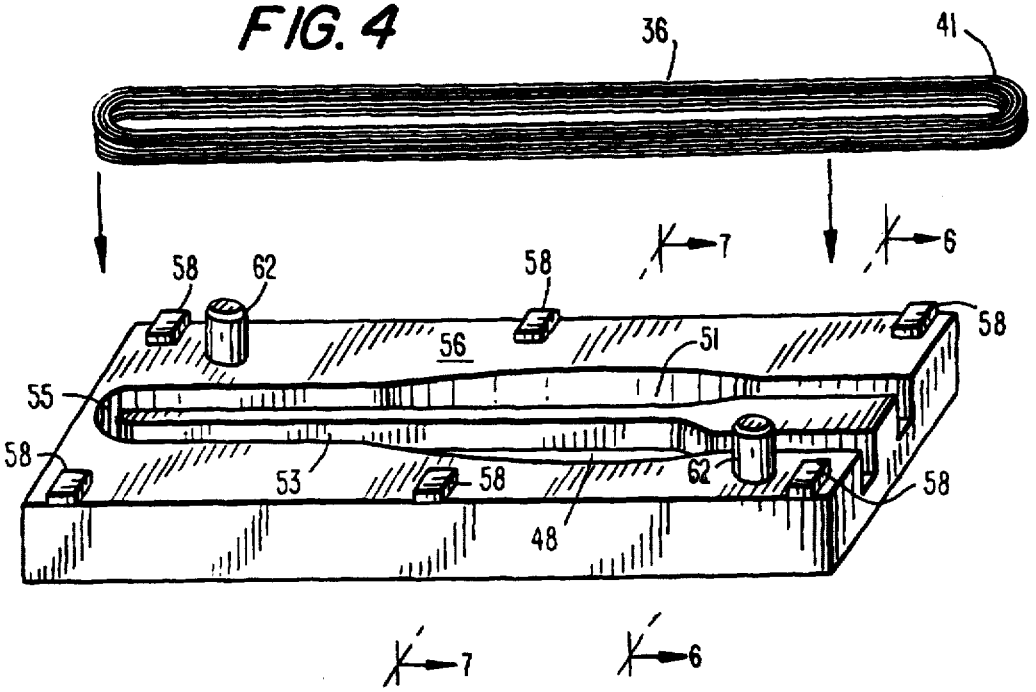
FIG. 4 is a perspective side elevation view of the lower mold and the impregnated filaments about to be placed thereon.
Figure 8:
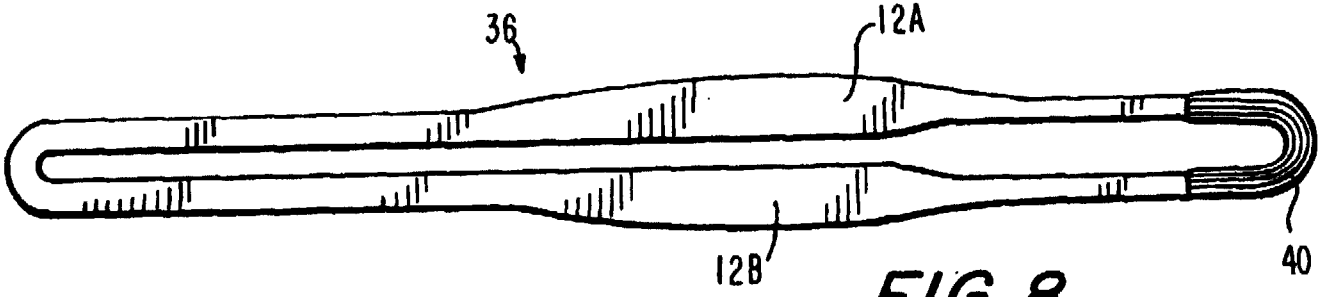
FIG. 8 is a plan elevation view of the cured limb slug as it is when removed from the mold assembly and before the filament tail is severed.

The slug 36 is in suitable condition to be molded by inserting it into the mold assembly 44 illustrated in FIG. 3. The frame 42 is positioned so that the slug 36 extends longitudinally within the lower mold 46 and the glass fiber filaments 40 extend out of the assembly 44 in the form of a tail 41 (see FIG. 5). The cavity 48 of the lower mold 46 in conjunction with the mating member 50 of upper mold 52 is shaped to form the slug 36 into the partially completed right limb portion 12A and left limb portion 12B, illustrated in FIG. 8. Cavity 48 contains a first cavity 51 which is profiled to provide the configuration of the right limb portion 12A and a second cavity 53 which is profiled to provide the configuration of the left limb portion 12B. First cavity 51 is parallel to second cavity 53 and connected therewith by the contiguous U-shaped cavity 55. As upper limb portions 12A and 12B are identical to lower limb portions 14A and 14B, only upper limb portions 12A and 12B are further described. The face 56 of the lower mold 46 is provided with stops 58 which limit the depth of penetration of member 50 into the cavity 48. Openings 60 of upper mold 52 receive alignment pins 62 of lower mold 46 when the mold is closed.

Two different cross sections of the glass fiber slug 36 in the upper mold 52 and lower mold 46 are shown in FIGS. 6 and 7. It will be noted that the cross section of slug 36 shown in FIG. 6 is of greater thickness, $T_1$, than the cross section of slug 36, $T_2$, shown in FIG. 7. Therefore, the glass fiber to resin ratio of the slug 36 cross section shown in FIG. 6 may be less than the glass fiber to resin ratio of the slug 36 cross section shown in FIG. 7. It is reasonable to have a lower glass fiber to resin ratio in the slug 36 cross section shown in FIG. 6 because the limb is subject to less stress in this area. Further, the increased thickness $T_1$ increases the desired limb stiffness in this area. On the other hand, it is desirable to have a higher glass fiber to resin ratio in the slug 36 cross section shown in FIG. 7 because the limb is subject to increased bending stress in this area. As shown in FIGS. 6 and 7, the differences in the greater thickness $T_1$ of slug 36 in FIG. 6 is achieved by increasing the depth of cavity 48 of lower mold 46.

As seen in FIGS. 6 and 7, the lower corner edges 64 of the formed slug 36 are molded with a radius along their length.

This is provided to avoid having to machine out stress-inducing sharp comers and also by molding in this radius the fiber filaments are uncut, continuous and protectively sealed in this highly stressed area.

Figure 9:
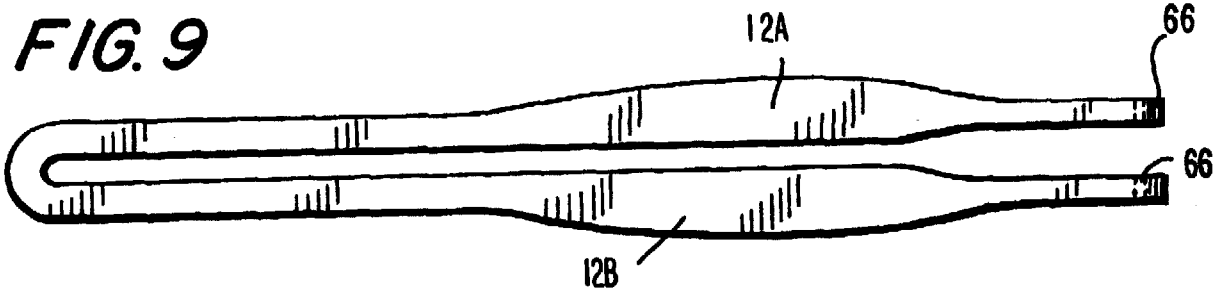
FIG. 9 is a plan elevation view of a left and right limb portions produced according to the present invention.
Figure 10:
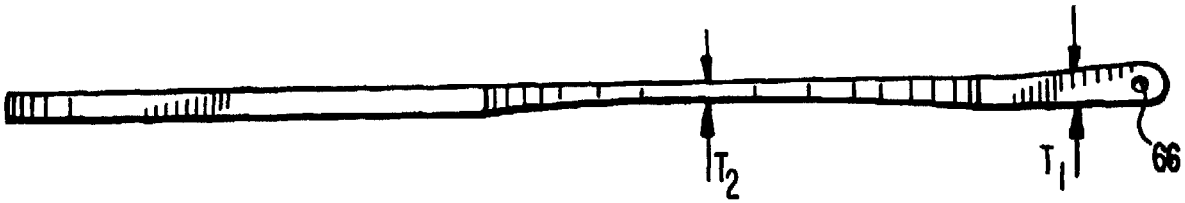
FIG. 10 is a side elevation view of the left and right limb portions shown in FIG. 9.

The initial curing of the slug 36 occurs when slug 36 is inserted into the mold assembly 44 which has been heated to an operating temperature of approximately 300° to 350° F. Slug 36 is maintained in the closed mold assembly 44 at this temperature for a period of 5 to 10 minutes, whereby slug 36 is set to assume the profile determined by the mold assembly 44. Slug 36 is then removed from the mold assembly 44 and the uncured glass fiber filaments forming the tail 40 are severed (see FIG. 9) The slug 36 is then cured by being placed in an oven at approximately 350° F. for a period of about three hours. Openings 66 are then machined in right limb portion 12A and left limb portion 12B for the purposes of receiving axle 20.

Having thus described the invention, it will be apparent to those skilled in the art that various modifications can be made within the scope of the invention.

Having thus described the invention, what is claimed as novel and desired to secure by Letters Patent is:

1. A method of compression molding a continuous right archery bow limb and a left archery bow limb comprising the steps of:

a) forming a moldable slug composed of a plurality of longitudinally oriented resin impregnated glass fiber filaments;

b) disposing said slug into a compression mold assembly comprising a first mold and a second mold, a cavity in the first mold and a mating member in the second mold, said cavity having a first cavity profiled to provide the configuration of the right limb portion and a second cavity profiled to provide the left limb portion, said first cavity and second cavity are in parallel relationship to each other, and said first cavity, second cavity, and mating member cooperate to form said slug into a right limb portion and a connected left limb portion; and c) curing said slug.

2. The method of compression molded a continuous right archery bow limb and a left archery bow limb as set forth in claim 1 wherein the first cavity and second cavity are connected to each other.

3. The method of compression molding a continuous right archery bow limb and a left archers bow limb as set forth in claim 2 wherein the mold assembly consists of at lest two cavities for simultaneously molding at least a right limb portion and a left limb portion.

4. The method of compression molding a continuous right archery bow limb and left archery bow limb as set forth in claim 2 wherein the first and second cavity are connected by a U-shaped cavity.

5. The method of compression molding a continuous right archery bow limb and a left archery bow limb as set forth in claim 1 wherein the right limb portion and left limb portion are formed side by side in mirror image cavities.

6. The method of compression molding a continuous right archery bow limb and a left archery bow limb as set forth in claim 1 wherein the mold assembly consists of at least two cavities for simultaneously molding at least a right limb portion and a left limb portion.

7. A compound archery bow including a handle, bow-string and pulley wheels and having improved compression molded continuous right and left limbs connected to said handle, wherein said limbs are produced by the method set forth in claim 1.

8. The method of compression molding a continuous right archery bow limb and left archery bow limb as set forth in claim 1 wherein said mold assembly includes means for varying the distance between portions of the cavity and mating member.

9. The method of compression molding a continuous right archery bow limb and left archery bow limb as set forth in claim 8 wherein the means for varying the distance between the cavity and mating member is a cavity of different depths.

10. A method of compression molding a continuous right archery bow limb and left archery bow limb comprising the steps of:

a) forming a moldable slug composed of a plurality of longitudinally oriented resin impregnated glass fiber filaments;

b) disposing said slug into a compression mold assembly comprising a first mold and a second mold, a cavity in the first mold and a mating member in the second mold, said cavity having a first cavity profiled to provide the configuration of the right limb portion and a second cavity, in non-linear relation to said first cavity, profiled to provide the left limb portion, and wherein said cavity and mating member cooperate to form said slug into a right limb portion and a connected left limb portion; and c) curing said slug.

11. A method of compression molding a continuous right archery bow limb and a left archery bow limb as set forth in claim 10, wherein the first and second cavity are connected to each other.

12. The method of compression molding a continuous right archery bow limb and left archery bow limb as set forth in claim 10, wherein said mold assembly includes means for varying the distance between the cavity and mating member.

13. The method of compression molding a continuous right archery bow limb and a left archery bow limb as set forth in claim 12, wherein the means for varying the distance between the cavity and mating member is a cavity of different depths.

14. The method of compression molding a continuous right archery bow limb and left archery bow limb as set forth in claim 10, wherein the mold consists of at least two cavities for simultaneously molding at least a right limb portion and a left limb portion.

15. A compound archery bow including a handle, bow-string and pulley wheels and having improved compression molded continuous right and left limbs connected to said handle, wherein said limbs are produced by the method set forth in claim 10.

* * * * *